United States Patent [19]
Van Noord
[11] 4,344,369
[45] Aug. 17, 1982

[54] TABLE WITH EXTENSIBLE TOP

[76] Inventor: Andrew J. Van Noord, 1434 Hillsboro, SE., Grand Rapids, Mich. 49506

[21] Appl. No.: 135,876

[22] Filed: Mar. 31, 1980

[51] Int. Cl.³ ..... A47B 1/00
[52] U.S. Cl. ..... 108/84; 108/86
[58] Field of Search ..... 108/85, 84, 86, 87, 108/89, 72, 136; 248/608

[56] References Cited

U.S. PATENT DOCUMENTS

| | | | |
|---|---|---|---|
| 551,701 | 12/1895 | Watkins | 248/608 |
| 726,853 | 5/1903 | Borgmann | 108/72 |
| 992,066 | 5/1911 | Roberts | 108/85 |
| 1,143,853 | 6/1915 | Olson | 108/84 |
| 1,208,018 | 12/1916 | Rogginger | 108/87 |
| 1,861,565 | 6/1932 | Hall | 108/84 |
| 1,985,620 | 12/1934 | Raphael | 108/72 |
| 2,170,098 | 8/1939 | Stephenson | 108/136 |
| 2,657,108 | 10/1953 | Lallier | 108/85 |
| 3,080,066 | 3/1963 | Berridge et al. | 108/136 |
| 3,099,232 | 7/1963 | Cooper | 108/83 |
| 3,813,073 | 5/1974 | Mohr et al. | 248/608 |

*Primary Examiner*—Francis K. Zugel
*Attorney, Agent, or Firm*—Varnum, Riddering, Wierengo & Christenson

[57] ABSTRACT

A table (10) includes an extensible top surface including end leaves (20, 22) which are slidably mounted on a frame (12). The end leaves (20, 22) are mounted by means of a roller mechanism (62, 66) which permits easy movement of the leaves between an opened and closed position to allow for insertion of a center leaf (28). The center leaf (28) is carried on the frame (12) and is displaceable between a down position below the top surface of the table and an up position wherein the center leaf forms a portion of the top surface. The leaf (28) is mounted to the table by means of a linkage (34, 46) which allows the center leaf (28) to be displaced between the up and down positions. In order to facilitate movement of the center leaf (28) to the up position, at least one torsion rod (40) or other spring element is mounted between the center leaf (28) and the table frame (12) to provide the desired biasing force to maintain the center leaf (28) in the up position.

12 Claims, 9 Drawing Figures

TABLE WITH EXTENSIBLE TOP

BACKGROUND OF THE INVENTION

1. Field of the Invention

The invention relates to tables having an extensible top surface wherein an extension leaf is stored below the table surface.

2. State of the Prior Art

Tables including extensible top surfaces such as dining room tables and the like have enjoyed widespread use. Such tables include a top surface having leaves which are slidably mounted on a frame. The slide mechanism for the leaves of the table may include a guide channel secured to the frame which receives a depending guide member on the bottom surface of the leaf of the table. In another embodiment, rollers may be used to support the leaves of the table wherein the rollers are received in a channel secured to the table leaf. This latter structure is often used with glass top tables wherein the glass is received in a channel-like frame extending about the edges of the leaf and the channel includes a depending guide channel for receiving a roller. These slide mounts allow for easy opening and closing of the leaves of the table when it is desired to add an extension leaf to provide a larger table surface.

Conventional tables have provided for extension of a table surface by permitting insertion of separate leaves as desired. These extension leaves often include extending dowels which are received in corresponding apertures in the edges of the leaves of the table. In order to install the extension leaves, the end leaves of the table are pulled apart by means of the slide mounts and the center leaf is inserted into place. The end leaves are then slid inwardly so that the dowels are received in the corresponding apertures. Such tables require that the center leaves be stored in a separate location from the table which may lead to warping of the leaves if not stored in a proper fashion. If the leaves warp, then precise alignment of the leaf when installed in the table would not be possible and an irregular top surface will result.

In order to alleviate this problem, some tables have incorporated a mechanism wherein the extension leaf is stored below the top surface of the table. One such table includes a center leaf which is stored in a lowered position and supported on the table by means of pins received in a cam-like slot provided on the side frame members of the table. When it is desired to install the leaf, the center leaf is raised so that the pin rides in the cam-like slot, thereby displacing the leaf upwardly until the top surface is even with the plane of the end leaves of the table. Such a mounting for the center leaf of a table is difficult to operate and does not always insure accurate alignment of the leaf with the other leaves of the table.

DESCRIPTION OF THE INVENTION

In accordance with the invention, a table includes an extensible top surface supported on a frame wherein the top surface includes end leaves slidably mounted to the frame and an extension surface or center leaf stored below the top surface which is displaceable into an up position by means of a linkage and torsion rod mechanism. The end leaves of the table are slidable between a closed position and an open position which allows insertion of the center leaf. The center leaf is supported on the frame by means of a linkage wherein the leaves are biased to the up position by a spring means which overcomes the weight of the center leaf when in the up position. In this way, an easy means for installing the center leaf is provided.

The end leaves of the table are slidably mounted on the frame by rollers carried on the frame of the table as well as on the edge portions of the end leaves. The linkage for supporting the center leaf includes lever arms pivoted at the corner portions of the center leaf so that the lever arms rotate through a predetermined angular displacement to translate the center leaf upwardly and align it with the top surface of the table. The spring means, which may comprise a torsion rod, supplies the necessary force to maintain the center leaf in the up position. The torsion rod is mounted between the table and the center leaf and has a sufficient force to bias the center leaf to an up position when the end leaves of the table are extended.

Such a linkage and torsion rod mechanism may be used with a glass top wherein the center leaf is mounted on a frame including a depending flange portion which pivotally mounts the linkage members. The linkage and torsion rod mechanism is not visible when mounted between the frame and center leaf so that a pleasing appearance is presented by the table. The linkage and torsion rod mechanism may be used with other types of table tops so long as the surfaces permit the mounting of the linkage between the table frame and the bottom portion of the leaf. In place of the torsion rod, other biasing means, such as coil or leaf springs, may be used to maintain the center leaf in the up position.

BRIEF DESCRIPTION OF THE DRAWINGS

The invention will be described with reference to the accompanying drawings wherein like members bear like reference numerals in which.

DETAILED DESCRIPTION OF THE PREFERRED EMBODIMENT

Figure 1:
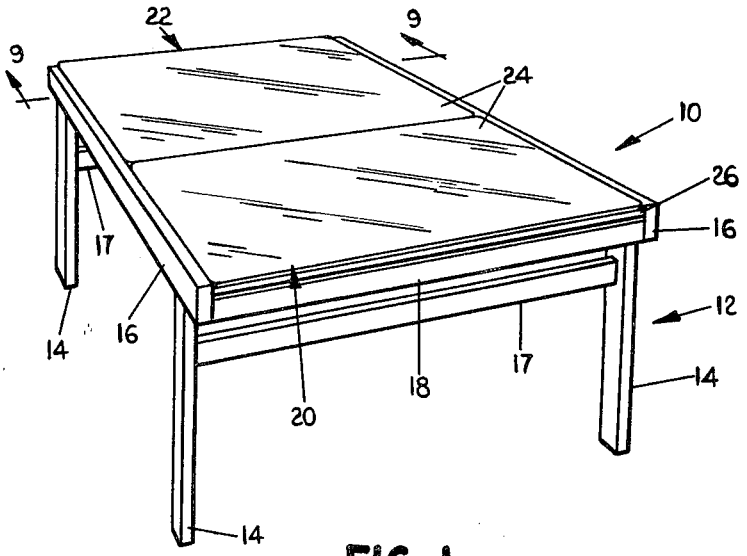
FIG. 1 is a perspective view of a table in accordance with the invention including an extensible top portion shown in the closed position.

With reference to FIGS. 1-4 and 8, a table 10 includes a frame 12 which includes legs 14, slide rails 16, stretcher bars or horizontal braces 17 and end rails 18 and 19. The members which comprise the frame 12 are preferably made of tubular frame members including planar and curved sections which are welded along adjacent edges. The configuration of the frame members may be selected to provide the desired aesthetic appearance. In order to enhance the appearance of the table, the frame members may be plated or otherwise coated to provide a pleasing appearance.

The frame 12 provides a structure for supporting a table top comprising end leaves 20 and 22. The end leaves are slidably mounted on the frame in a manner to be described below with reference to FIG. 9. The slidable end leaves 20, 22 are displaceable so as to follow the insertion of an extension leaf which is typically placed in the center portion of the frame. The end leaves of the table may comprise a glass top portion 24 which is seated on the support frame 26. The glass top 24 provides a pleasing appearance in conjunction with the plated frame members, but other forms of table tops may be used in its place. The support frame 26 on which the glass top 24 is mounted is formed of metal tubing. The above-described table is conventional and is depicted in FIG. 1.

Figure 2:
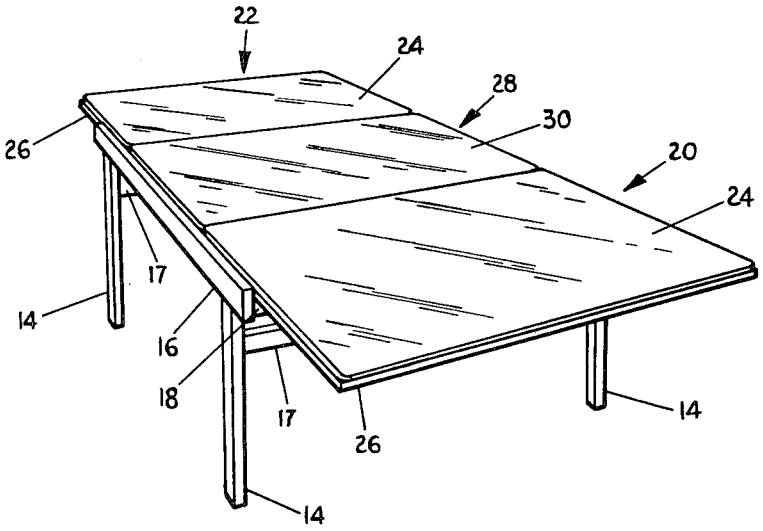
FIG. 2 is a perspective view of the table including the extensible top shown in the extended position.
Figure 3:
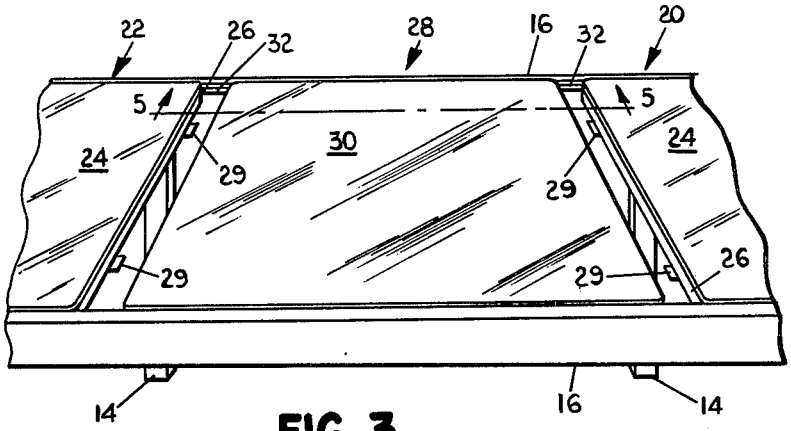
FIG. 3 is a partial perspective view of the table showing the center portion thereof with the center leaf in the up position.
Figure 4:
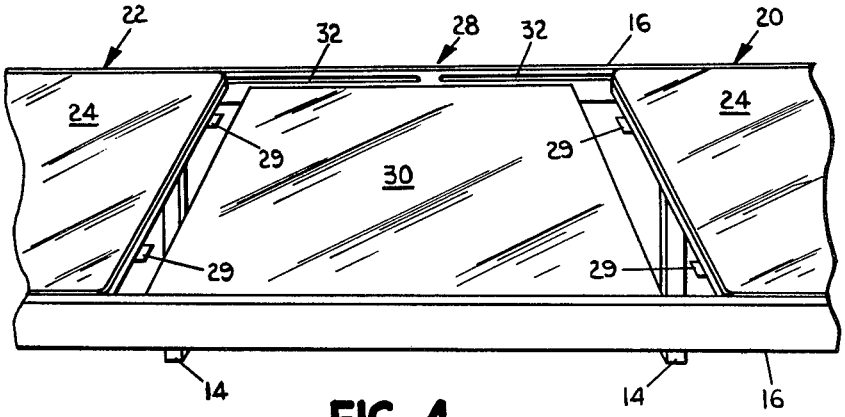
FIG. 4 is a partial perspective view of the center portion of a table showing the center leaf in the down position.
Figure 8:
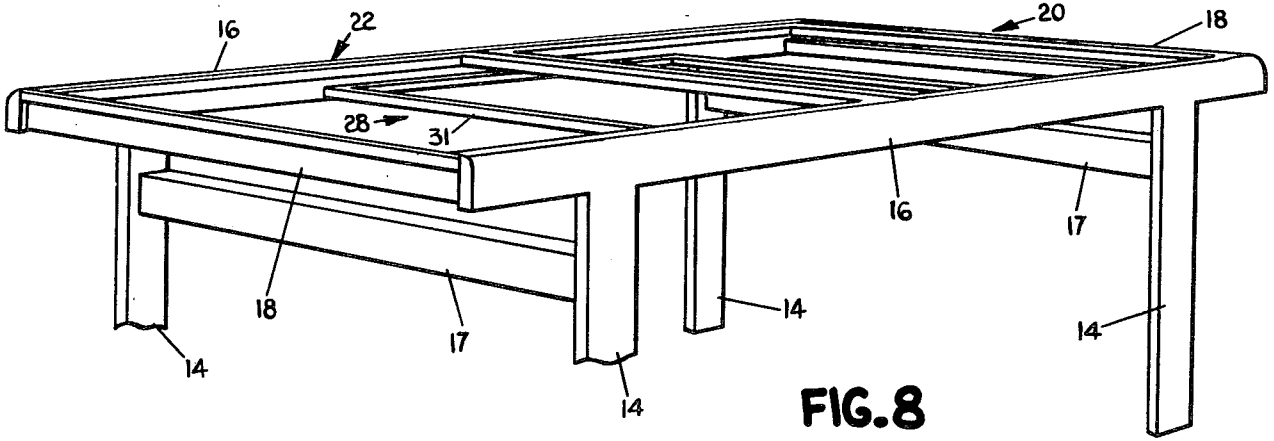
FIG. 8 is a perspective view of the frame of the table in accordance with the invention.

As shown in FIG. 2, the end leaves 20 and 22 of the table have been displaced in opposite directions so as to allow the insertion of a center leaf 28 in order to provide a larger table surface. The center leaf 28 is similar to the end leaves and may comprise a glass top portion 38 received in a frame 31, which is shown in FIG. 8. The frame 31 includes a depending flange 33 which provides for mounting of the center leaf to the table by a linkage to be described below. While it is conventional to provide such a center leaf extension for a table, such as a dining room table, the table, according to the present invention, stores the center leaf in a unique manner. The center leaf 28 is operatively connected to the table in a manner to be described below so that the center leaf can be stored below the top surface of the table when not in use. FIG. 3 shows the center leaf 28 in the up position, so that when the end leaves 20 and 22 are spread apart, the center leaf 28 is raised to form part of the top surface of the table. The leaf may be supported by support tabs 29 carried on the edge portions of the end leaves 20 and 22. FIG. 4 shows the center leaf 28 in the down position which permits the end leaves 20 and 22 to be displaced towards each other to form a smaller table surface, as illustrated in FIG. 1. As can be seen in FIG. 4, the inner surfaces of the side rail 16 include track members 32 in which the end leaves 20 and 22 are slidably mounted.

Figure 5:
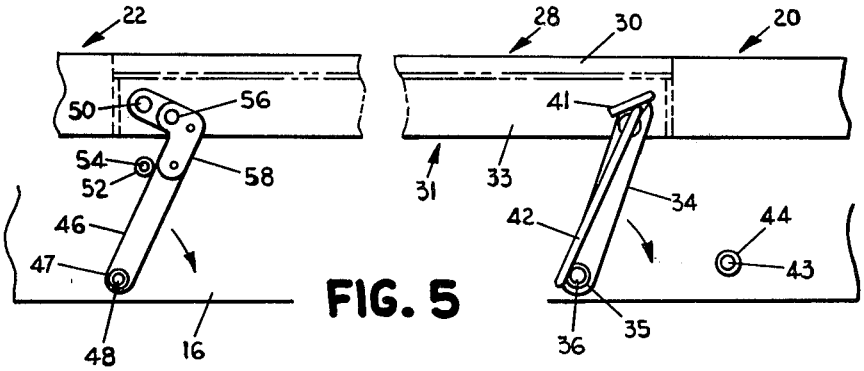
FIG. 5 is a view taken along lines 5—5 of FIG. 3 showing the torsion bar linkage mechanism in accordance with the invention.
Figure 7:
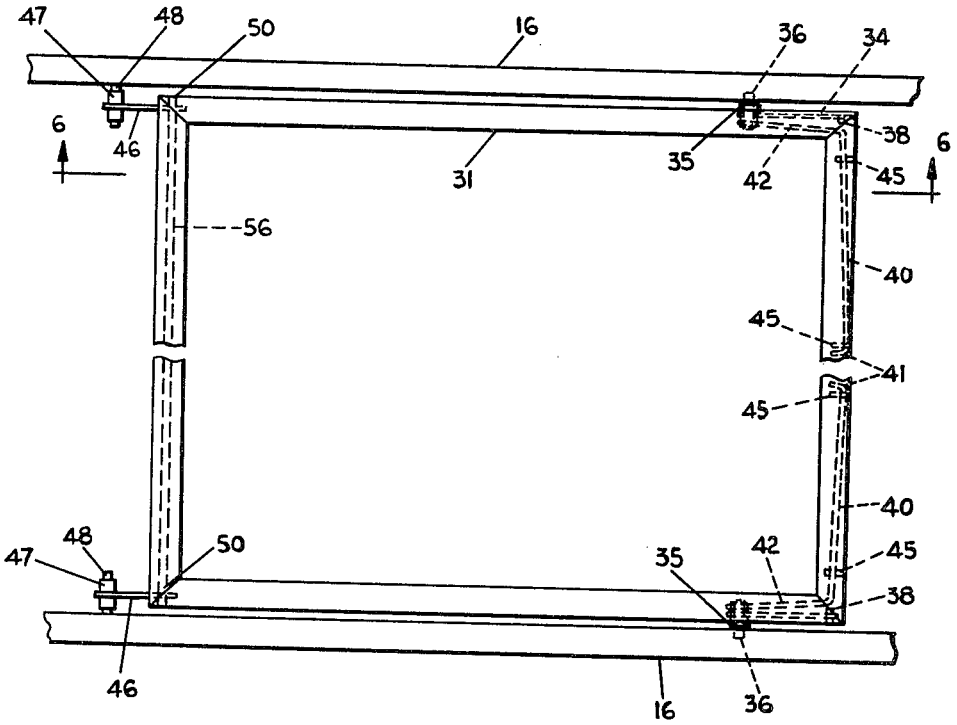
FIG. 7 is a top view of the center leaf of the table in accordance with the invention.

With reference to FIG. 5, the mechanism for raising and lowering the center leaf 28 is shown. This mechanism includes a first lever 34 which carries a sleeve 35 at one end which is pivotally mounted to a pin 36 disposed on side rail 16. The second end of the lever 34 is received on a pin 38 mounted to the depending flange 33 of support frame 31 which forms part of the center leaf 28. A similar lever 34 is mounted on the opposite side of the center leaf 28, as shown in FIG. 7. In this way, the end of the center leaf 28 adjacent end leaf 20 is pivotally connected to the frame.

The opposite end of the center leaf is also pivotally mounted to the frame by means of a lever 46 which comprises an L-shaped link. The arm of the lever 46 carries a cylindrical sleeve 47 at one end which is pivoted on a pin 48 secured in side rail 16 of the frame whereas the L-shaped portion is pivotally mounted to a pin 50 carried on flange 33 of support frame 31 of the center leaf. The sleeves 47, in conjunction with sleeves 35 carried on levers 34, maintain the frame 31 in the table opening and prevent rubbing against the table frame 12. Each side of the center leaf member 31 is pivotally connected to side rail 16 by such a lever 46, as shown in FIG. 7. Levers 34 and 46 therefor form a linkage for translating the center leaf between the down position shown in FIG. 4 and the up position shown in FIG. 3.

Figure 6:
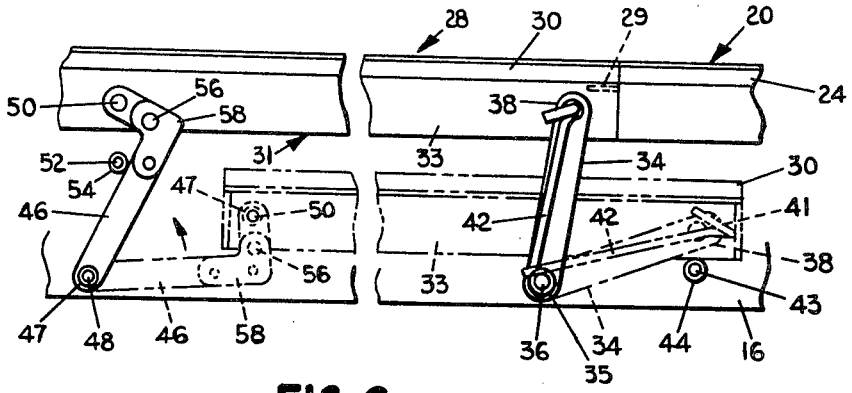
FIG. 6 is a view taken along line 6—6 of FIG. 7 showing the center leaf and linkage mechanism in the up position in full lines, and in the down position in phantom lines.

In order to maintain the center leaf 28 in the up position when raised, at least one torsion rod 40 is mounted between the frame 12 and the center leaf support frame 31. As shown in FIGS. 5–7, the torsion rod 40 comprises an elongated section 40 carried on the under surface of frame 31 and secured thereto by a hook portion 31 received in a slot on flange 45 secured to the frame 31. The opposite end of the torsion rod 40 is an extending arm portion 42 which is secured to frame member 16. The arm portion 42 of the torsion rod 40 may be wedged against pin 36 secured to the side rail 16 so as to fix arm 42 relative to the center leaf 28. Such torsion rods 40 may be provided on each side of the frame 31 so as to provide balanced movement of the center leaf 28 between the up and down positions. The torsion rod 40 provides sufficient torsional force to hold the center leaf 28 in the up position when the end leaves 20 and 22 are spread apart. Adjustment of the torsional force exerted by torsion rod 40 is accomplished by changing the angle at which the end portion 41 of the bar 40 is secured to the frame 31. The torsional force on the center leaf by the torsion rod 40 is insufficient to overcome the force of gravity when the leaf is in the down position but is generally sufficient to hold the leaf up when the leaf is in the up position illustrated in full lines in FIG. 6. Although the table has been described as including a torsion rod for maintaining the center leaf in the up position, other types of springs or biasing means may be used. For example, coil springs, torsion springs or the like may be disposed between the table frame and center leaf to provide the desired biasing force to hold the center leaf in place.

In order to limit displacement of the center leaf between the up and down positions, stop members 43 and 52 are provided on the side rail 16. Stop member 43 comprises a pin extending from the inner wall of side rail 16 about which a sleeve 44 is secured. The sleeve 44 is preferably made from polyethylene in order to eliminate annoying noises created by metal to metal contact between the pin and the lever 34. The sleeve 44 limits the downward displacement of the center leaf 28 so that adjustment of the down position of the leaf is made possible by changing the diameter size of the sleeve. Likewise, stop member 53 includes a sleeve 54 against which lever 46 abuts to thereby limit upward displacement of the center leaf 28. Again, the size of the sleeve 54 may be changed so as to alter the height of the center leaf 28 when in the raised position so that the center leaf 28 will be level with the end leaves 20 and 22.

With reference to FIGS. 5–7, a stabilizer bar 56 may be mounted between levers 46 which are disposed on opposite sides of the support frame 31. The stabilizer bar 56 may be an elongated rod which extends the width of the center leaf 28 in order to further rigidify the support frame 31. The bar 56 is secured to a mounting bracket 58 which is carried on the inner surface of lever 46 and secured thereto. In this way, the stabilizer bar 56 will not interfere with the operation of the linkage mechanism. The stabilizer bar 56 coordinates movement of the linkages on each side of the table so that smooth raising and lowering of the leaf is provided. Accordingly, the center leaf may be raised by lifting one corner, with the bar 56 coordinating movement of the linkages.

Figure 9:
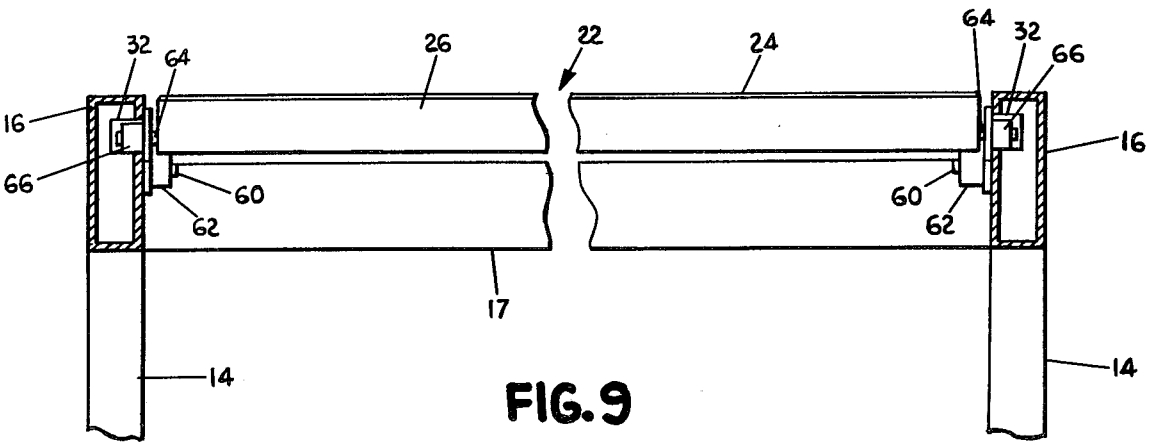
FIG. 9 is a view taken along lines 9—9 of FIG. 1 showing the sliding mount for the end leaves of the table.

As shown in FIG. 9, each end leaf 20, 22 is slidably mounted on the frame by means of rollers 62 and 66. The rollers 66 are mounted on pins 64 which extend from the sides of support frame 26 of the end leaves 20, 22. The rollers 66 are received in tracks 32 formed in side rail 16 to thereby slidably mount the end leaf to the frame. In order to provide additional support when sliding the end leaves 20, 22, the side rails 16 of the frame include rollers 62 mounted on pins 60 which extend inwardly from the side rails 16. The rollers 62 engage the bottom surface of the frame 26. In this way, the rollers 62 and 66 facilitate sliding of the end leaves between the open and closed positions.

The above-described table includes a relatively simple means for storing and inserting an extension leaf for a table such as a dining room table. In order to insert the center leaf 28 into place to enlarge the top surface of the table, it is only necessary to slide the end leaves 20, 22 apart. The center leaf 28, which has been stored below the top surface of the table when in the closed position, is easily raised with the assistance of the torsional force exerted by torsion rod 40. The center leaf is connected to the frame by the linkage which rotates the center leaf through a selected arc about a pivot point on the linkage. The center leaf rotates from the stored position through a first portion of the arc and into the up position through the remainder of the arc. Only a slight upward force is necessary to overcome the inertial weight of the center leaf, but the torsion rods 40 will provide the needed force to maintain the center leaf 28 in the up position. After overcoming the gravitational movement of the center leaf, the torsion rods 40 translates the leaf 28 into the up position until the links 34, 46 abut the stop members 44, 58 which limit the degree to which the center leaf 28 can be raised. The torsion rods provide a rotational moment towards the second or upper arc portion which is less than the moment generated by the center leaf when in the first arc portion. Thus, it is necessary to apply a slight lifting force to the center leaf to move it to the up position. Once the moment provided by the torsion rods overcomes the opposing moment due to the center leaf the leaf travels through the second portion of the arc to the up position. When the leaf 28 has been raised, the end leaves 20, 22 are then pushed inwardly so that the inner edges of the end leaves are adjacent to the center leaf 28 to provide a uniform table surface. The tab members 29 on the inner edges of the end leaves provide additional support for the center leaf to prevent downward displacement under the influence of an unusually heavy load. If it is desired to remove the leaf 28, the end leaves are extended until the tabs 29 clear the undersurface of the center leaf 28, so that pushing of the center leaf downwardly will return it to the stored position. Once in the stored position, the weight of the center leaf 28 overcomes the upward force exerted by the torsion rods 40 to thereby retain the center leaf 28 in the down or stored position. The end leaves 20, 22 can then be slid back into place to present the smaller table surface shown in FIG. 1. It thus can be seen that the center leaf is maintained in the down position by the difference between the moments generated by the torsion rods and center leaf in the first portion of the arc and maintained in the up position by the difference between the moments generated by the torsion rods and center leaf in the second portion of the arc.

The linkage and torsion rod mechanism as described above provides a unique and simple means for raising and lowering the center leaf when it is desired to provide a larger table area. No unwieldy pivoting mechanisms wherein leaves of the table are unfolded from overlapping positions when stored are needed to insert the center leaf extension. By storing the center leaf under the top surface of the table and providing a spring-assisted mechanism for raising and maintaining the leaf in an up position, no great physical force is required to install the leaf. Additionally, the rollers for slidably mounting the end leaves also facilitate opening and closing of the table.

Although the table has been described with reference to a glass top surface including tubular frame members, other types of table surfaces and frames may be used with the pivot mechanism described above. It is necessary that the torsion rods or other biasing means have sufficient force to overcome the weight of the center leaf when the leaf is in the up position to prevent unintended downward displacement of the leaf. Additionally, the displacement of the linkage mechanism must be appropriately limited by means of properly sized stop members so that the center leaf, when in the up position, is at the same height as the end leaves of the table. These two requirements can be easily obtained by properly selecting the torsion rod or other spring members and size of the stop members. No alteration of the other elements of the invention would be required if any modifications to the table are made.

The foregoing description and drawings are merely illustrative of the invention and are not intended to limit the invention to the above-described embodiment. Variations and changes which are within the scope of one skilled in the art are intended to be within the scope and nature of the invention as defined by the appended claims.

The embodiments of the invention in which an exclusive property or privilege is claimed are defined as follows:

1. A table having an extensible top surface comprising:

a frame;

a top surface including end leaves slidably mounted to said frame;

said end leaves slidable between a closed position wherein said leaves are positioned adjacent each other to form said top surface and an open position wherein said leaves are spaced apart to permit insertion of an extension surface;

said extension surface including a center leaf carried on said frame and displaceable between a down position wherein said center leaf is stored below said top surface when the end leaves are in the closed position and an up position wherein said center leaf forms a portion of said top surface when said end leaves are in the open position;

linkage means for operatively connecting said center leaf to said frame, whereby said center leaf is rotatable through a selected arc about a pivot point on said linkage means between said down position at a first portion of said arc and said up position at a second portion of said arc; and spring means for biasing said center leaf for pivotable movement about the selected arc to said up position;

said spring means providing a rotational moment towards said second arc portion less than an opposite rotational moment generated by the center leaf when said center leaf is in the first arc portion and a rotational movement greater than an opposite rotational movement generated by the center leaf when said center leaf is in the second portion of said arc;

wherein said center leaf is maintained in said down position by the difference between the moments generated by the spring means and the center leaf in the first portion of said arc and is maintained in said up position by the difference between the moments generated by the spring means and the center leaf in the second portion of said arc, wherein said spring means includes at least one torsion bar mounted between said frame and said center leaf;

said torsion bar including a first arm portion operatively connected to said frame and extending along said linkage means and an elongated second arm portion operatively connected to said center leaf and extending from said first arm portion at generally right angles thereto;

said first arm portion providing a levering force for lifting said center leaf and said second arm portion providing a rotational moment for lifting said center leaf;

whereby said at least one torsion bar raises said center leaf to the up position when said end leaves are in the open position.

2. The table of claim 1 wherein said slidable mounting for said end leaves includes rollers pivotally secured to said end leaves and tracks disposed on said frame for receiving said rollers.

3. The table of claim 2 wherein said slidable mounting further includes rollers pivotally secured to said frame which slidably engage the undersurface of each of said end leaves when said end leaves are displaced between said open and closed positions.

4. The table of claim 1 wherein each of said end leaves includes at least one support member for engaging said center leaf when in the up position to provide further support therefor.

5. The table of claim 1 wherein said linkage means includes lever arms which operatively connect said center leaf to said frame, said lever arms pivotally mounted to said frame and said center leaf.

6. The table of claim 5 wherein said lever arms are mounted in cooperating pairs on opposite sides of said center leaf, thereby providing a linkage for displacing said center leaf between said up and down positions.

7. The table of claim 6 including means for coordinating movement of said lever arms disposed on opposite sides of said center leaf, thereby providing smooth operation of said linkage.

8. The table of claim 7 wherein said means for coordinating movement of said lever arms includes at least one rod member extending across a width of said center leaf and secured to at least one of said cooperating pairs of lever arms.

9. The table of claim 6 including means for limiting the rotational movement of said lever arms to a predetermined angular displacement, thereby aligning said center leaf with said end leaves when in the up position and supporting said center leaf in the down position.

10. The table of claim 9 wherein said means for limiting rotational movement is at least one stop member against which at least one said lever arms abuts.

11. The table of claim 1 including two torsion bars mounted between said frame and said center leaf.

12. The table of claim 11 wherein said linkage means includes lever arms pivotally mounted at a first end to said frame and at a second end to said center leaf so that said lever arms translate said center leaf from said down position to said up position in response to the force of said two torsion bars acting on said center leaf.

* * * * *